US008944170B2

(12) United States Patent
Hansen

(10) Patent No.: US 8,944,170 B2
(45) Date of Patent: Feb. 3, 2015

(54) REAL TIME DOWNHOLE INTERVENTION DURING WELLBORE STIMULATION OPERATIONS

(75) Inventor: Henning Hansen, Alicante (ES)

(73) Assignee: Ziebel AS, Tananger (NO)

( * ) Notice: Subject to any disclaimer, the term of this patent is extended or adjusted under 35 U.S.C. 154(b) by 788 days.

(21) Appl. No.: 13/128,681

(22) PCT Filed: Nov. 16, 2009

(86) PCT No.: PCT/NO2009/000389

§ 371 (c)(1),
(2), (4) Date: Jul. 27, 2011

(87) PCT Pub. No.: WO2010/059060

PCT Pub. Date: May 27, 2010

(65) Prior Publication Data

US 2012/0048570 A1 Mar. 1, 2012
US 2012/0227981 A9 Sep. 13, 2012

Related U.S. Application Data

(60) Provisional application No. 61/115,589, filed on Nov. 18, 2008.

(51) Int. Cl.

| | |
|---|---|
| ***E21B 34/14*** | (2006.01) |
| ***E21B 34/06*** | (2006.01) |
| ***E21B 43/26*** | (2006.01) |
| ***E21B 23/00*** | (2006.01) |

(52) U.S. Cl.

CPC ..... *E21B 34/14* (2013.01); *E21B 34/06* (2013.01); *E21B 43/26* (2013.01); *E21B 23/00* (2013.01)

USPC ..... 166/386; 166/373; 166/250.04

(58) Field of Classification Search

CPC ..... E21B 34/14
USPC ..... 166/308.1, 177.5, 332.3, 250.04, 386, 166/373

See application file for complete search history.

(56) References Cited

U.S. PATENT DOCUMENTS

| | | | |
|---|---|---|---|
| 6,192,983 B1 | 2/2001 | Neuroth et al. | |
| 2004/0065439 A1 | 4/2004 | Tubel et al. | |
| 2006/0124310 A1 * | 6/2006 | Lopez de Cardenas et al. | 166/313 |

FOREIGN PATENT DOCUMENTS

| | | |
|---|---|---|
| WO | WO 2006/003477 A2 | 1/2006 |
| WO | WO 2006003477 A2 * | 1/2006 |
| WO | WO 2008091155 A1 * | 7/2008 |

* cited by examiner

*Primary Examiner* — William P Neuder
*Assistant Examiner* — Richard Alker
(74) *Attorney, Agent, or Firm* — Gable Gotwals

(57) ABSTRACT

A method for completing a wellbore having a plurality of stimulation valves disposed therein at longitudinally spaced apart locations includes moving a spoolable rod into the wellbore. The rod includes a plurality of spaced apart sensors therein. At least one valve operating dart is applied to an exterior of the spoolable rod. The dart is configured to engage a selected one of the stimulation valves. A position of the at least one dart is estimated during pumping of fluid into the wellbore by measuring output of the sensors in the rod.

8 Claims, 2 Drawing Sheets

REAL TIME DOWNHOLE INTERVENTION DURING WELLBORE STIMULATION OPERATIONS

CROSS-REFERENCE TO RELATED APPLICATIONS

This application is the United States National Phase of PCT Patent Application No. NO2009/000389 filed on 16 Nov. 2009, which was published in English on 27 May 2010 under Publication No. WO 2010/059060 A1, which claims priority to U.S. Provisional Application No. 61/115,589 filed 18 Nov. 2008, both of which are incorporated herein by reference.

FIELD OF THE INVENTION

The invention relates generally to the field of wellbore based reservoir stimulation operations. More specifically, the invention relates to methods for wellbore intervention during reservoir stimulation through the wellbore.

BACKGROUND ART

To increase productivity of oil and/or gas wells, hydraulic stimulation (fracturing) is typically used. One method of fracturing in wells including a plurality of depth-separated producing formations includes installation of stimulation valves, so-called "frac sleeves", adjacent to each of the formations to be stimulated by fracturing. The fracturing is performed by pumping fluid within a string of casing or tubing installed in the wellbore. A typical well completion configuration is shown in FIG. 1A for multiple formations 17 each having an associated frac sleeve. FIG. 1B shows a ball 13 which is used to open the frac sleeve 10 having been inserted into the sleeve 10 in a selected position in the casing or tubing 12.

Each of the valves or frac sleeves wherein a plurality of such frac sleeves is used, can be opened by dropping a matching or mating ball (13 in FIG. 1B) or "dart" into the casing from the Earth's surface, and then pumping the ball or dart down the well until the ball seats in a profile in the frac sleeve to be opened. Pressurizing the well from surface further after engagement of the ball or dart with the profile forces the ball or dart downward, which results in opening a valve in the frac sleeve. After the valve is opened, fluid is injected into the particular formation through the opened valve, as shown in FIG. 1B.

FIG. 1B also illustrates zonal isolation devices 14 disposed between the frac sleeves. Such devices can be packers or similar annular sealing devices. Also the entire string of tubing or casing with frac sleeves disposed therein can be cemented in place in the wellbore, where the cement creates a fluid tight barrier between the various formations.

Because it is desirable to monitor in real time the stimulation process in the wellbore, which can be performed for example, using longitudinally distributed sensors such as temperature sensors, pressure sensors, acoustic sensors, etc., it is desirable to be able to use a device having such sensors thereon that is compatible with pumping darts or balls into the wellbore.

A method for completing a wellbore according to one aspect of the invention, where the wellbore has a plurality of stimulation valves disposed therein at longitudinally spaced apart locations, includes moving a spoolable rod into the wellbore. The rod includes a plurality of spaced apart sensors therein. At least one valve operating dart is applied to an exterior of the spoolable rod. The dart is configured to engage a selected one of the stimulation valves. A position of the at least one dart is estimated during pumping of fluid into the wellbore by measuring output of the sensors in the rod.

Other aspects and advantages of the invention will be apparent from the following description and the appended claims.

DETAILED DESCRIPTION

Figure 1A:
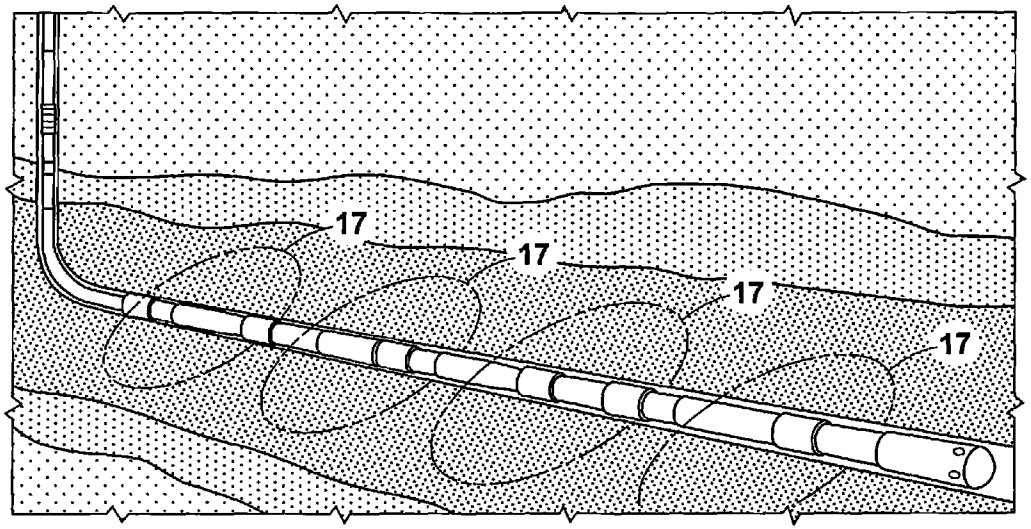
Fig. 1A ( PRIOR ART )
FIGS. 1A and 1B shows a typical wellbore completion where a number of zonal isolation packers and ball-drop operated sleeves are utilized.
Figure 1B:
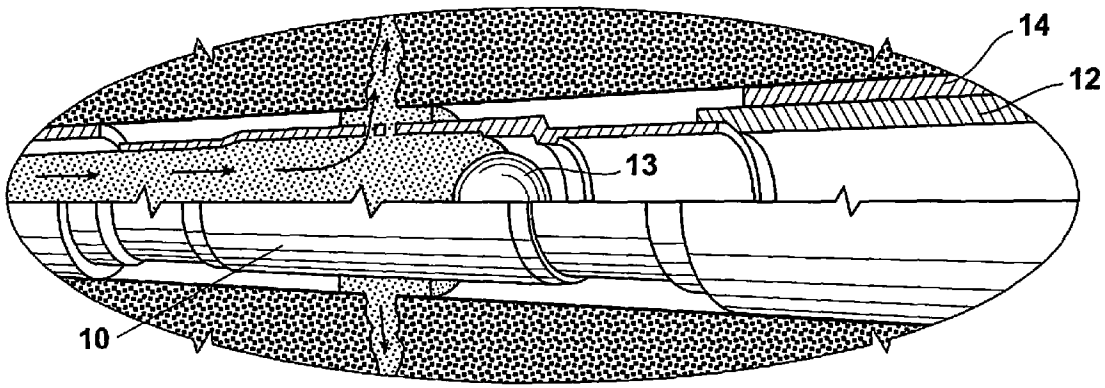
Fig. 1B ( PRIOR ART )

A semi stiff, spoolable rod system containing sensing fibers and/or electrical cable(s) for sensing has been developed and demonstrated by the assignee of the present invention. Such spoolable rod is used to provide services under the service mark ZIPLOG, which is a service mark of the assignee of the present invention. The system is based on pushing the spoolable rod into producing and/or fluid injection wellbores. The spoolable rod is typically disposed on a reel or winch and is pushed inside a tubing string (production tubing) inserted into the well coaxially with the wellbore casing by operating the winch. By having sensing elements, for example, optical fiber temperature and/or pressure sending elements, at spaced apart positions incorporated into the spoolable rod, it is possible to provide real time data to the surface about well conditions during production, injection and shut-in. The foregoing spoolable rod to provide ZIPLOG services includes such sensing elements Referring to FIG. 2, the spoolable rod 20 is deployed into a casing 12 cemented in a wellbore 18 and past one or more of the stimulation valve(s) 10 (which can be frac sleeves as described in the Background section herein). Prior to inserting the spoolable rod 20, one or more darts or balls 16 of suitable dimension can be mounted externally on the rod 20 at the Earth's surface. The darts or balls 16 are mounted into a system at the surface where the operator is able to release them when and as required. Then, the darts or balls 16 are released, and fluid can be pumped into the casing 12 from the surface. The darts or balls 16 are then pushed into the casing 12 by the pumped fluid. The darts or balls 16 will move along the outer surface of the rod 20 into the casing 12 until they land in a matching one of the stimulation valves 10 (frac sleeves). As each dart or ball 16 reaches the matching stimulation valve 10 it stops at a shoulder or "no-go" (see FIGS. 4A and 4B) formed into the interior surface of the valve 10. Further fluid pressurizing the casing 12 from the surface pushes the dart or ball 16 downward against the shoulder or no-go (FIGS. 4A and 4B), resulting in shifting a sleeve in the stimulation valve 10, causing the stimulation valve 10 to open. Opening the stimulation valve 10 enables fluids to be pushed out into the rock formation (17 in FIG. 1A) adjacent to the stimulation valve 10 from within the casing 12.

The dart's or ball's 16 position along the exterior of the spoolable rod during pumping into the wellbore can be estimated during fluid pumping by measuring the amount of fluid pumped in, or by cooling of the spoolable rod 20. Cooling of the rod 20 can be estimated or monitored by measurements from distributed temperature sensors 19 in the spoolable rod 20, as well as by acoustic detection (using suitable pressure sensors incorporated into the rod 20) of the dart or ball 16 traveling into the casing 12. The fluids pumped into the casing 12 typically have a different temperature than exists at many depths within the wellbore; therefore, temperature measuring along the spoolable rod 20 will generally suffice to indicate the position of the fluids moving down into the casing 12 from the surface.

Figure 3:
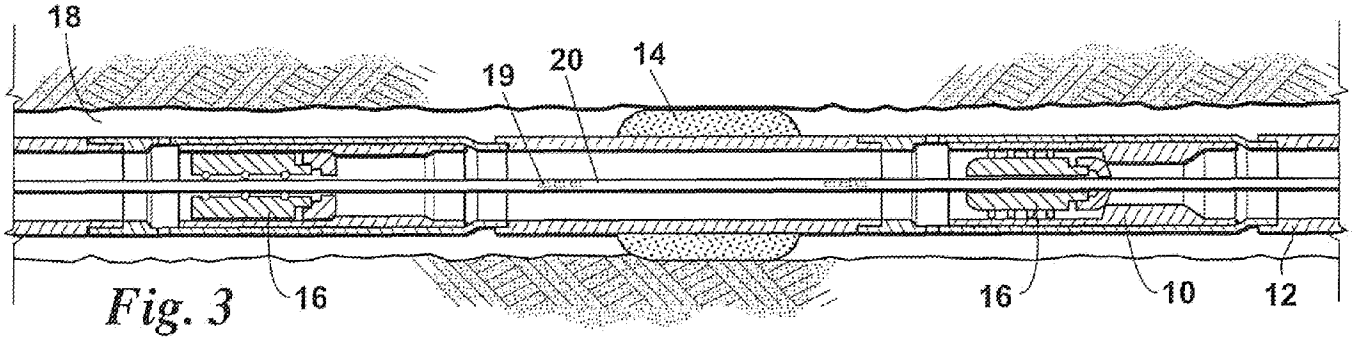
FIG. 3 shows dropping second dart into the wellbore.

FIG. 3 shows an example of how more balls or darts 16 can be pumped into the wellbore to a valve placed shallower than a valve used earlier. One drawback of a fixed diameter shoulder or no-go as a landing place for the dart or ball as described above is that the balls or darts must become successively smaller in diameter (toward the bottom of the well) as more stimulation valves are included in a particular completion. Such diameter limitation is a result of the fact that in order for a dart or ball to reach a valve at greater depth than other valves in the wellbore, the dart or ball must be able to freely pass through all the shallower placed stimulation valves. The foregoing may result in very small internal diameter in the lowermost valves, and can cause the available internal diameter to be insufficient for deploying a well logging tool or similar device through the lowermost valve(s), or may limit the effective flow rate of the stimulation fluid.

In an alternative embodiment each stimulation valve 10 can have the same internal diameter. A locating profile (see FIGS. 4A and 4B) having a unique shape as compared to that in the other stimulation valves in the wellbore, a so called "selective profile", can be implemented in each stimulation valve sleeve shifting device. The darts 16 each have a matching locating profile for only one of the stimulation valves 10. Each dart 16 will land and position itself only in the one valve 10 having the matching landing profile. Using such a dart and stimulation valve configuration, a plurality of valves can be installed in the wellbore without having internal diameter changes.

Figure 4A:
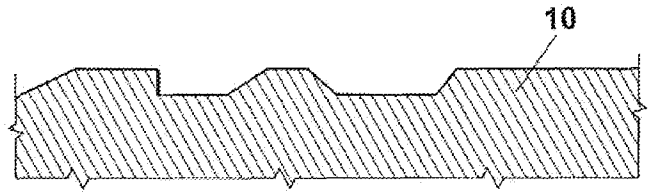
FIGS. 4A and 4B show example selective profiles.
Figure 4B:
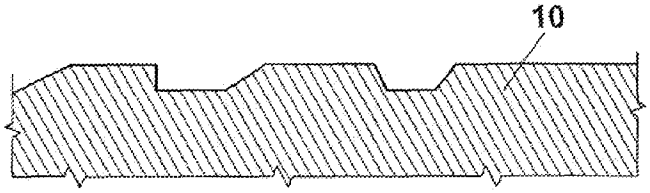

FIG. 4A illustrates examples of selective profiles on the darts can be used with stimulation valves in the well having matching profiles. The profile shown at in FIG. 4A, if applied to the exterior of a dart, will not engage in a receiving profile on a valve having shape shown in FIG. 4B, but only in a profile having the shape shown in FIG. 4A. The same is the case for a profile having the shape in FIG. 4B, which will only engage in a matching shaped profile. Each stimulation valve can have a unique landing profile so that a correspondingly shaped dart will only engage in such valve.

Figure 2:
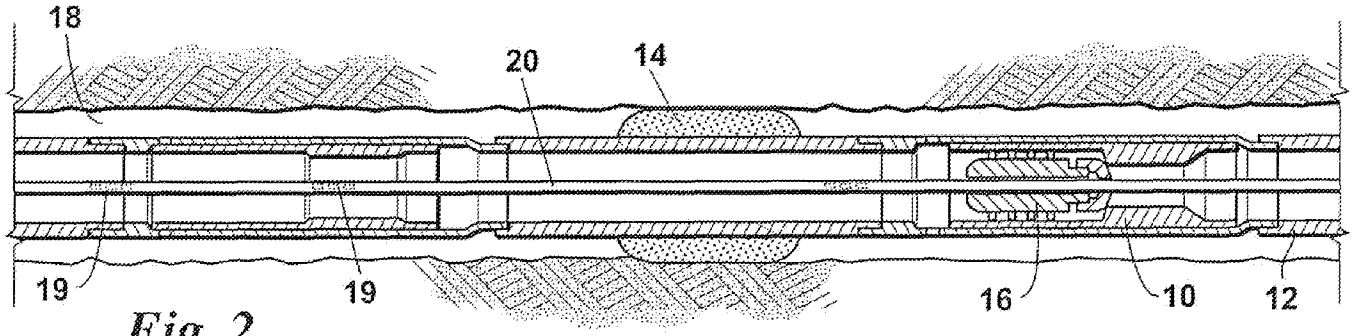
FIG. 2 shows a first dart dropped and landed in stimulation valve ("frac sleeve"), where dart opens valve by pressurizing tubing from surface.

During fluid pumping operations, as explained above, distributed temperature and/or pressure sensors included in the spoolable rod (20 in FIG. 2) may be used to monitor progress of the fluid as it is pumped into the casing (12 in FIG. 2). Upon completion of wellbore stimulation, the well can be opened for production whereupon the darts will be transported by fluid production to the surface. Alternatively, the spoolable rod (20 in FIG. 2) can be pulled out of the casing (12 in FIG. 2), bringing all the darts 16 to the surface.

A completion system as explained above may have stimulation valves all having substantially the same interior diameter, and may include the capability of estimating progress of fluid pumped into the wellbore during pumping operations.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method for completing a wellbore having a plurality of stimulation valves disposed therein at longitudinally spaced apart locations, said method comprising the following steps:

moving a spoolable rod into the wellbore, the rod including a plurality of spaced apart sensors therein;

applying at least a first valve operating dart to an exterior of the spoolable rod; the at least a first dart configured to engage only a selected one of the stimulation valves; and pumping of fluid into the wellbore and the pumped fluid thereby moving the at least a first dart along the spoolable rod to engage the selected one of the stimulation valves.

2. The method of claim 1 further comprising determining a position of the at least first dart, during the pumping of fluid into the wellbore, by measuring output of the sensors in the rod.

3. The method of claim 1 wherein the sensors comprise temperature sensors.

4. The method of claim 1 further comprising causing the selected one of the stimulation valves to open by continuing movement of the dart after the dart engages the selected one of the stimulation valves.

5. The method of claim 1 further comprising applying at least a second valve operating dart to the exterior of the spoolable rod and determining a position thereof during pumping of fluid into the wellbore, the at least a second dart configured to engage only a second one of the stimulation valves.

6. The method of claim 4 wherein the first and second darts each have an exterior profile configured to engage a mating profile in a respective one of the stimulation valves.

7. The method of claim 1 further comprising removing the at least a first dart by withdrawing the spoolable rod from the wellbore.

8. The method of claim 1 further comprising removing the at least a first dart by withdrawing fluid from a subsurface reservoir through the wellbore.

* * * * *